US012780529B2

(12) United States Patent
Xia et al.

(10) Patent No.: US 12,780,529 B2
(45) Date of Patent: Nov. 3, 2026

(54) FLEXIBLE BAG BODY AND COOLER BAG

(71) Applicant: ZHEJIANG NATURAL OUTDOOR GOODS INC., Taizhou (CN)

(72) Inventors: Yonghui Xia, Taizhou (CN); Jingjing Yuan, Taizhou (CN); Guorui Cao, Taizhou (CN)

(73) Assignee: ZHEJIANG NATURAL OUTDOOR GOODS INC., Taizhou (CN)

( * ) Notice: Subject to any disclaimer, the term of this patent is extended or adjusted under 35 U.S.C. 154(b) by 60 days.

(21) Appl. No.: 18/921,266

(22) Filed: Oct. 21, 2024

(65) Prior Publication Data

US 2026/0084886 A1 Mar. 26, 2026

(30) Foreign Application Priority Data

Sep. 25, 2024 (CN) ..... 202411350252.7

(51) Int. Cl.
*B65D 81/38* (2006.01)
*B65D 33/01* (2006.01)

(52) U.S. Cl.
CPC ..... *B65D 81/3897* (2013.01); *B65D 33/01* (2013.01)

(58) Field of Classification Search
CPC ..... B65D 81/3897; B65D 33/01
USPC ..... 383/110
See application file for complete search history.

(56) References Cited

U.S. PATENT DOCUMENTS 11,772,874 B1 * 10/2023 Block ..... B65D 33/04 383/110
2006/0198562 A1 * 9/2006 Mogil ..... A45C 7/0077 383/121.1
2007/0274613 A1 * 11/2007 Pruchnicki ..... A45C 7/0077 383/110
2013/0279037 A1 * 10/2013 Wong ..... G02B 7/182 359/871
2017/0280937 A1 * 10/2017 Mogil ..... A47J 41/0066
2017/0320653 A1 * 11/2017 Mogil ..... B65D 81/3897
2018/0192824 A1 * 7/2018 Mogil ..... A45C 11/20

FOREIGN PATENT DOCUMENTS

CN 102616476 A 8/2012

* cited by examiner

*Primary Examiner* — Peter N Helvey
(74) *Attorney, Agent, or Firm* — Westbridge IP LLC

(57) ABSTRACT

Disclosed are a flexible bag body and a cooler bag. The flexible bag body is enclosed to form a cavity, and the flexible bag body is sequentially provided with an inner layer fabric, a filling layer and an outer layer fabric from inside to outside. The flexible bag body is provided with a plurality of crease portions, one of the plurality of crease portions includes a plurality of grooves formed in the flexible bag body along a predetermined track line. The filling layer is provided with an opening, and the inner layer fabric and the outer layer fabric are connected at the opening, so that a surface of the inner layer fabric and a surface of the outer layer fabric are sunken to form one of the plurality of grooves; and the flexible bag body is provided a folded state and an unfolded state.

21 Claims, 17 Drawing Sheets

FLEXIBLE BAG BODY AND COOLER BAG

CROSS-REFERENCE TO RELATED APPLICATIONS

This application claims priority to Chinese Patent Application No. 202411350252.7, filed on Sep. 25, 2024, the content of which is incorporated herein by reference in its entirety.

TECHNICAL FIELD

The present disclosure relates to the technical field of daily necessities, and specifically relates to a flexible bag body and a cooler bag.

BACKGROUND

With the rapid economic development, people's pace of life and work has accelerated. The advent of cooler bags has brought great convenience to people's daily lives. Cooler bags can be used to store various foods and maintain their temperature and freshness. However, many cooler bags on the market are not foldable, taking up a significant amount of space when not in use and making them inconvenient for storage. Although there are some foldable cooler bags available, they do not have designated folding creases on their surfaces. Their overall structure is made of flexible materials, allowing them to be folded in various ways when not in use. Different people, or even the same person at different times, may fold the cooler bag differently, resulting in low folding efficiency and causing the cooler bag surface to have more irregular folds, thus compromising its appearance.

SUMMARY

In order to solve one of the above technical deficiencies, embodiments of the present disclosure provide a flexible bag body and a cooler bag.

According to a first aspect of the embodiment of the present disclosure, a flexible bag body is provided, the flexible bag body is enclosed to form a cavity, and the flexible bag body is sequentially provided with an inner layer fabric, a filling layer and an outer layer fabric from inside to outside; and the flexible bag body is provided with a plurality of crease portions, one of the plurality of crease portions comprises a plurality of grooves, and the plurality of grooves are formed in the flexible bag body along a predetermined track line;

wherein the filling layer is provided with an opening, and the inner layer fabric and the outer layer fabric are connected at the opening, so that a surface of the inner layer fabric and a surface of the outer layer fabric are sunken to form one of the plurality of grooves; and the flexible bag body is provided a folded state and an unfolded state, and in the folded state, the flexible bag body is bent and deformed at least on two sides of a part of one of the plurality of crease portions.

Optionally, the flexible bag body comprises a plurality of side pieces, and the plurality of side pieces enclose to form the cavity; and one of the plurality of side pieces is provided with one of the plurality of crease portions.

Optionally, one of the plurality of grooves is a long strip groove; and when the flexible bag body is in the unfolded state and is supported on a horizontal supporting surface, one of the plurality of grooves is parallel to the horizontal supporting surface; or one of the plurality of grooves is perpendicular to the horizontal supporting surface; or an included angle is formed between one of the plurality of grooves and the horizontal supporting surface, and the included angle is an acute angle or an obtuse angle.

Optionally, a sealing cavity is formed between the inner layer fabric and the outer layer fabric;

the inner layer fabric or the outer layer fabric is provided with an air nozzle, and the air nozzle communicates with the sealing cavity; and one of the plurality of grooves is isolated from the sealing cavity.

Optionally, one of the plurality of crease portions includes a first crease portion, and the first crease portion extends in a circumferential direction of the flexible bag body.

Optionally, the first crease portion comprises a plurality of grooves arranged at intervals, and connecting lines of all the grooves form an annular closed crease line.

Optionally, when the flexible bag body is in the unfolded state, all the grooves are located in the same plane.

Optionally, one of the plurality of crease portions includes a plurality of second crease portions; and when the flexible bag body is in the unfolded state and is supported on the horizontal supporting surface, an included angle is formed between one of the plurality of second crease portions and the horizontal supporting surface. One of the plurality of second crease portions extends obliquely, and an included angle is formed between one of the plurality of second crease portions and the first crease portion.

Optionally, at least two intersecting second crease portions are respectively arranged on the two opposite side pieces of the flexible bag body, and four end portions of the two intersecting second crease portions are positioned away from each other in opposite directions.

Optionally, the flexible bag body comprises two first side pieces, a second side piece and a third side piece;

the second side piece and the third side piece are arranged on two sides of one of the two first side pieces respectively, and the second side piece and the third side piece are connected to the two first side pieces respectively; and two intersecting second crease portions are arranged on the two first side pieces, wherein one end of one of the two intersecting second crease portions extends to a midpoint or a top end point of a top of the second side piece, and another end of one of the two intersecting second crease portions extends to a midpoint or a bottom end point of a bottom of the third side piece; one end of another one of the two intersecting second crease portions extends to a midpoint or a top end point of a top of the third side piece, and another end of another one of the two intersecting second crease portions extends to a midpoint or a bottom end point of a bottom of the second side piece.

Optionally, one of the plurality of crease portions includes a plurality of third crease portions, all the third crease portions are sequentially arranged at intervals in the circumferential direction of the flexible bag body, and an included angle is formed between one of the plurality of third crease portions and the first crease portion; and the flexible bag body is arranged to be rotated and folded in an inclination direction of one of the plurality of third crease portions, so that the height is reduced.

Optionally, the flexible bag body comprises a plurality of side pieces, and each of the plurality of side pieces is provided with at least one of the plurality of third crease portions.

Optionally, one of the plurality of third crease portions is arranged on an upper side and/or a lower side of the first crease portion.

Optionally, one of the plurality of third crease portions and the first crease portion are sequentially and alternately arranged in a height direction of the flexible bag body.

Optionally, one of the plurality of crease portions includes a fourth crease portion, the fourth crease portion is distributed on a whole surface of the flexible bag body, and a plurality of triangular areas are formed between the fourth crease portions; and the flexible bag body is provided with a plurality of different folded states.

Optionally, one of the plurality of crease portions comprises a fifth crease portion, the fifth crease portion is distributed on the whole surface of the flexible bag body, a plurality of fifth crease portions are arranged, the plurality of fifth crease portions are parallel to the horizontal supporting surface, the plurality of fifth crease portions are perpendicular to the horizontal supporting surface, and a plurality of rectangular areas are formed between the fifth crease portions; and the flexible bag body is provided with a plurality of different folded states.

Optionally, two ends of a bottom of the flexible bag body further comprise a fifth crease portion that forms an included angle with the horizontal supporting surface, and fixing pieces matched with each other are arranged at the two ends of the bottom of the flexible bag body and two ends of a waist portion of the flexible bag body.

Optionally, the filling layer is provided with a plurality of hole portions; and in the unfolded state, the outer layer fabric forms an outer convex pattern at one of the plurality of hole portions.

Optionally, the filling layer is provided with a plurality of through holes.

According to a second aspect of the embodiment of the present disclosure, a cooler bag is provided, comprising:

a cooler bag housing; and the aforementioned flexible bag body, wherein the flexible bag body is detachably connected to the cooler bag housing.

Optionally, the cooler bag housing and the flexible bag body are matched in any one of the following modes:

the cooler bag housing is provided with an accommodating cavity, and the accommodating cavity is arranged to accommodate the flexible bag body;

the cooler bag housing is provided with a first magnetic attraction portion, the flexible bag body is provided with a second magnetic attraction portion, and the first magnetic attraction portion and the second magnetic attraction portion are magnetically attracted to each other;

the cooler bag housing is provided with a first buckle, the flexible bag body is provided with a second buckle, and the first buckle and the second buckle are clamped and fixed; and both the cooler bag housing and the flexible bag body are provided with hook-and-loop fasteners, and the cooler bag housing and the flexible bag body are bonded and fixed through the hook-and-loop fasteners.

By adopting the aforementioned technical solutions, the present disclosure has the following beneficial effects.

According to the present disclosure, the flexible bag body is provided with the crease portions, making it easy to fold and thereby facilitating storage, ultimately providing users with an enhanced experience.

BRIEF DESCRIPTION OF THE DRAWINGS

The accompanying drawings are used to provide a further understanding of the present disclosure, which constitutes a part of the present disclosure. The illustrative embodiments of the present disclosure, as well as their descriptions, are used to explain the present disclosure and are not intended to impose any undue limitations on it. In the accompanying drawings.

DETAILED DESCRIPTION OF THE EMBODIMENTS

To make the technical solutions and advantages of the embodiments in the present disclosure clearer, the following provides a detailed description of the exemplary embodiments with reference to the accompanying drawings. It should be noted that the described embodiments are only part of the present disclosure and not an exhaustive list of all possible embodiments. Furthermore, in the absence of conflict, the embodiments and their features in the present disclosure may be combined with each other.

Figure 1:
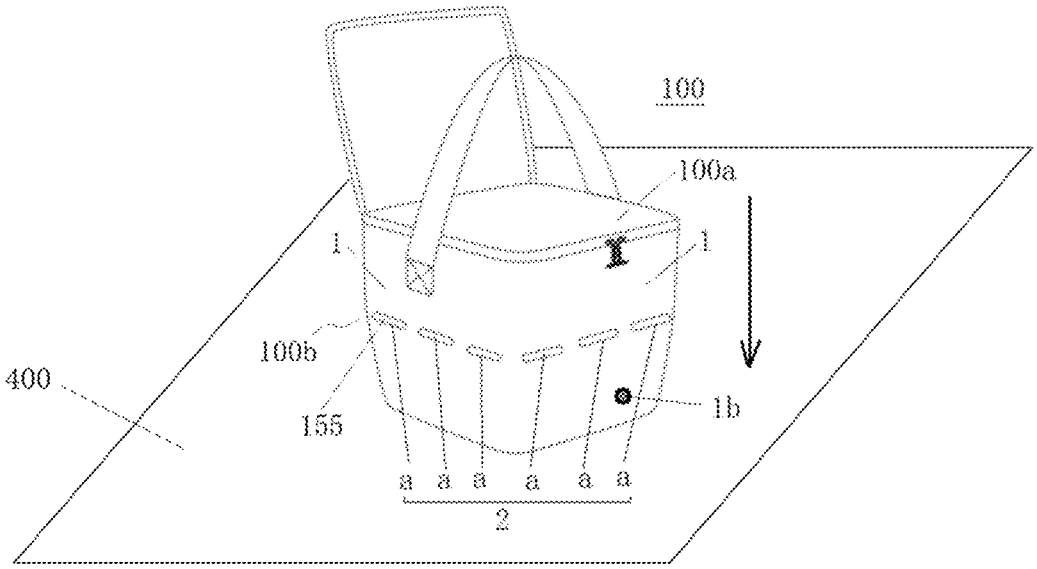
FIG. 1 shows a schematic diagram of providing a first crease portion on a flexible bag body according to an embodiment of the present disclosure.

FIG. 1 shows a structural schematic diagram of a flexible bag body 100 according to an embodiment of the present disclosure. The flexible bag body 100 is enclosed to form a cavity 100*a*, which can be used for accommodating objects requiring insulation. The flexible bag body 100 is provided with a crease portion 100*b* to facilitate folding. When the flexible bag body 100 is compressed, it bends and deforms on both sides of the crease portion, changing its shape and reducing its volume, thereby making storage more convenient. In the embodiment of the present disclosure, the flexible bag body 100 is provided with the crease portions 100*b*, which serves as an auxiliary means for folding, assisting users in quickly folding the bag body into a predetermined shape, thus enhancing the folding efficiency. Moreover, it prevents creases from forming at undesired locations on the flexible bag body 100, protecting the flexible bag body 100 and ensuring that its appearance remains clean and aesthetically pleasing for an extended period, thereby improving the durability of the flexible bag body 100.

As shown in FIG. 1 to FIG. 15, a plurality of crease portions 100*b* can be arranged on the flexible bag body 100 to enable folding of various parts of the flexible bag body 100, thereby minimizing its storage volume.

Figure 3:
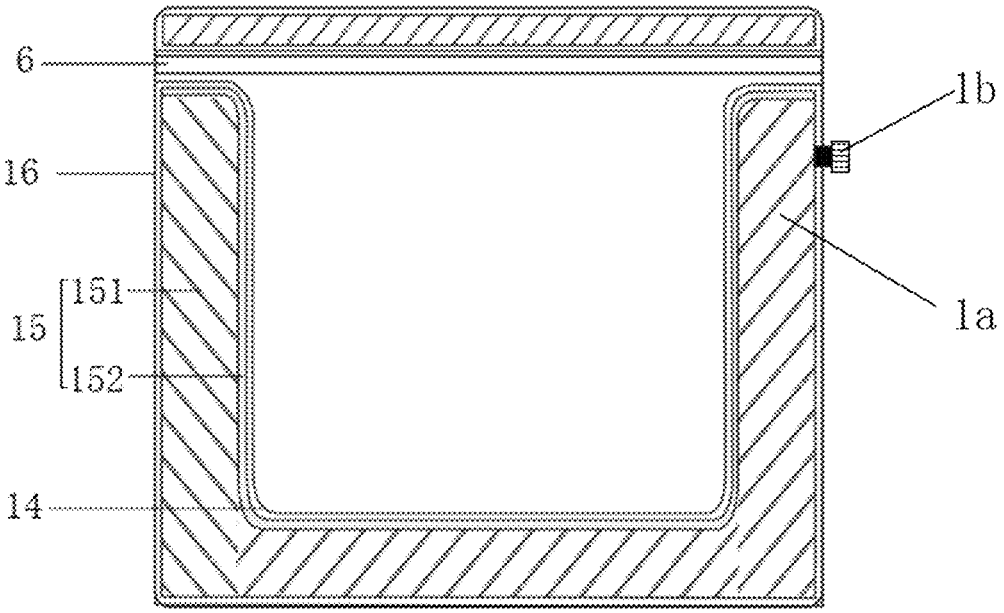
FIG. 3 shows a first structural schematic diagram of providing a first crease portion and a second crease portion on a flexible bag body according to an embodiment of the present disclosure.

FIG. 3 shows a cross-sectional view of a flexible bag body provided by an embodiment of the present disclosure. The flexible bag body 100 is sequentially provided with an inner layer fabric 14, a filling layer 15 and an outer layer fabric 16 from inside to outside. The filling layer 15 is positioned between the inner layer fabric 14 and the outer layer fabric 16. The plurality of crease portions 100*b* of the flexible bag body 100 in the present disclosure are not formed through repeated folding but are specifically designed to create permanently effective and aesthetically pleasing crease portions 100*b*.

In some possible embodiments, as shown in FIG. 1 to 15, one of the plurality of crease portions 100*b* comprises a plurality of grooves a formed in the flexible bag body 100 along a predetermined track line. The filling layer 15 is provided with an opening 155, and the inner layer fabric 14 and the outer layer fabric 16 are connected at the opening 155. Both the outer layer fabric 16 and the inner layer fabric 14 extend into the opening 155 and are contact-connected, so that a surface of the inner layer fabric 14 and a surface of the outer layer fabric 16 are sunken to form one of the plurality of grooves 'a'. The section of the inner filling layer 15 corresponding to one of the plurality of grooves 'a' lacks a solid structure and instead provides holes, naturally reducing the structural stiffness at the crease portions. When external force is applied to the flexible bag body 100, bending deformation occurs preferentially at the crease portions 100*b*. The flexible bag body 100 is provided a folded state and an unfolded state, and in the folded state, the flexible bag body 100 is bent and deformed at least on two sides of a part of one of the plurality of crease portions 100*b*. In the unfolded state, the surfaces of the bag body structure on both sides of one of the plurality of crease portions 100*b* can transition smoothly.

In some possible embodiments, the outer layer fabric 16 and the inner layer fabric 14 are fixedly connected at the opening by means of a hot-melt connection. When the outer layer fabric 16 and the inner layer fabric 14 come into contact, they are heated, causing them to bond directly and securely. The use of hot-melt between the outer layer fabric 16 and the inner layer fabric 14 offers advantages such as strong adhesion, rapid bonding speed, and high bonding strength.

In some possible embodiments, the outer layer fabric 16 and the inner layer fabric 14 can be fixedly connected at the opening 155 through adhesive bonding. Liquid or semi-solid glue can be applied to the facing surfaces of the inner layer fabric 14 and the outer layer fabric 16. Subsequently, they are directly aligned and pressed together at the opening 155. Once the glue dries, the two fabrics are securely bonded.

In some possible embodiments, as shown in FIG. 1, the flexible bag body 100 comprises a plurality of side pieces 1, and the plurality of side pieces 1 enclose to form the cavity

100*a*. Each of the plurality of side pieces 1 is provided with at least a portion of the crease portions 100*b*. The crease portions are arranged on each of the plurality of side pieces 1 of the flexible bag body 100, ensuring that all side pieces 1 of the flexible bag body 100 can fold and deform synchronously, preventing the formation of creases in non-folding areas during the folding process, thus enhancing folding efficiency.

In some possible embodiments, one of the plurality of grooves a is a long strip groove. When the flexible bag body is in the unfolded state and is supported on a horizontal supporting surface, one of the plurality of grooves a is parallel to the horizontal supporting surface 400; or one of the plurality of grooves a is perpendicular to the horizontal supporting surface 400; or an included angle is formed between one of the plurality of grooves a and the horizontal supporting surface 400, and the included angle is an acute angle or an obtuse angle. Each of the plurality of grooves a independently adopts one of the aforementioned three configurations.

The long strip groove extends along the predetermined track line. The long strip groove renders a longer region of the flexible bag body 100 with low structural stiffness, thereby making this region prone to deformation and facilitating smooth bending and deformation during the process of folding the flexible bag body.

Figure 24:
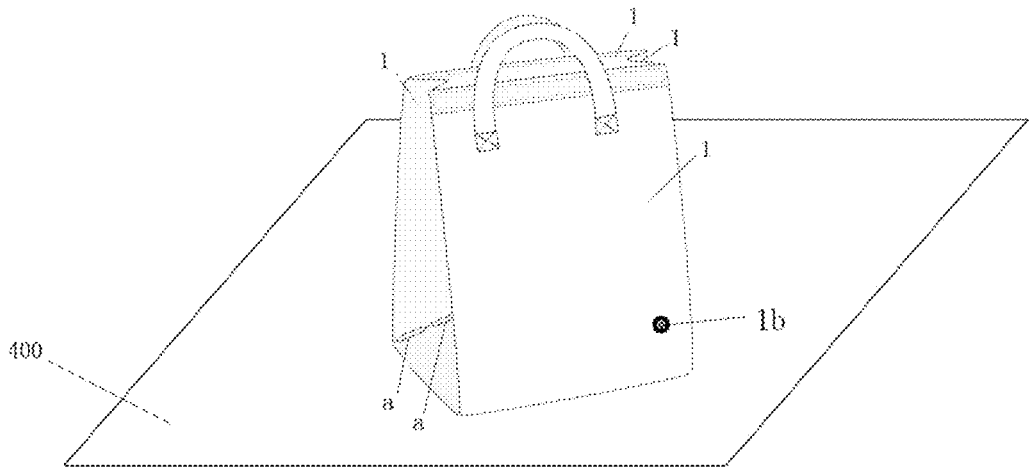
FIG. 24 shows a perspective view of a flexible bag body according to an embodiment of the present disclosure.
Figure 25:
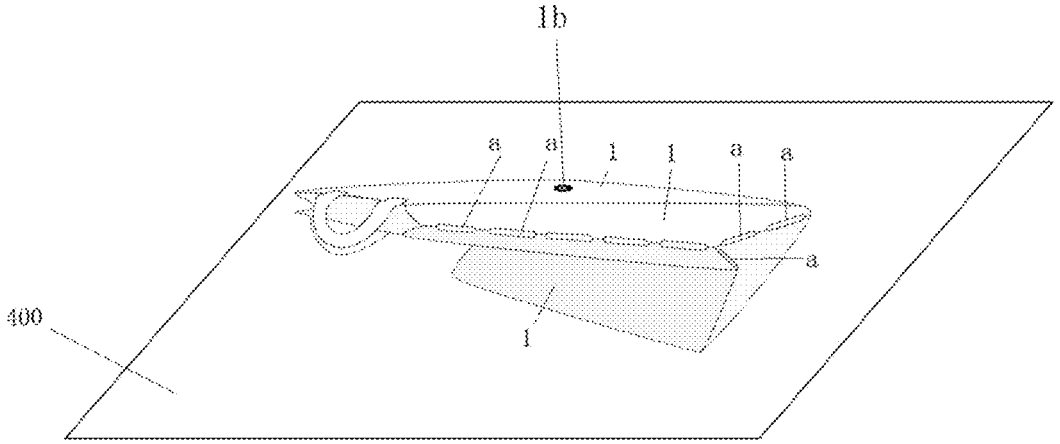
FIG. 25 shows a schematic diagram of the flexible bag body in FIG. 24 in a folded state.

As shown in FIG. 24 and FIG. 25, the flexible bag body comprises four side pieces 1 and a bottom piece connected with the four side pieces 1, the four side pieces 1 are enclosed to form a top opening, a crease portion 100*b* extending in the longitudinal direction is arranged in the middle of the two opposite side pieces 1 in the four side pieces 1, and in the state that the flexible bag body 100 is supported on the horizontal supporting surface 400, the crease portion extending in the longitudinal direction comprises a plurality of grooves a which are sequentially arranged, and each groove a is perpendicular to the horizontal supporting surface 400, and two inclined crease portions extending towards two sides of the bottom of the side piece 1 are arranged at the bottom of the longitudinally extending crease portion. The inclined crease portion comprises a plurality of obliquely extending grooves a. The flexible bag body also comprises an inner layer fabric, a filling layer and an outer layer fabric, and the flexible bag body 100 is provided with an air nozzle 1*b*. Consumers can squeeze the flexible bag body 100 from both sides along its thickness direction, causing it to deform and bend at each crease portion, ultimately folding into a flat structure, which facilitates storage.

Figure 2:
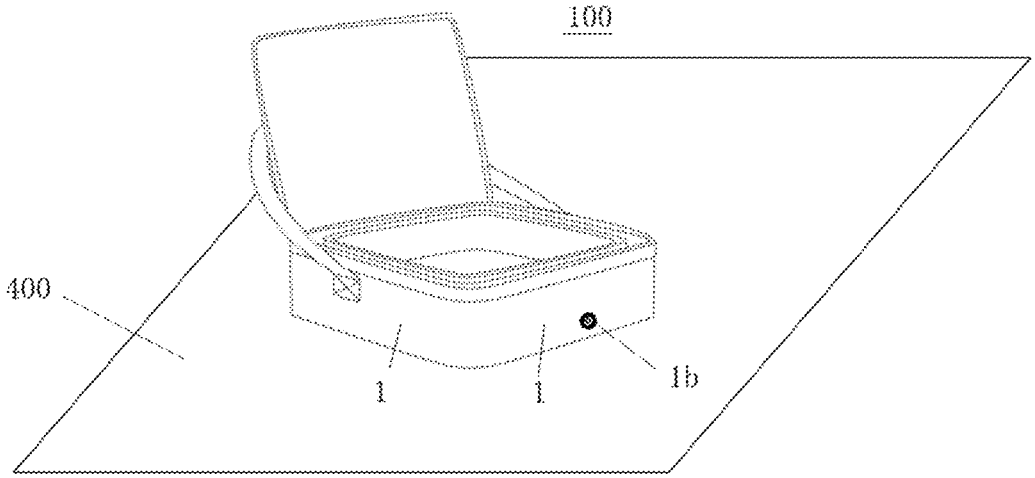
FIG. 2 shows a schematic diagram of pressing the flexible bag body in the direction indicated by the arrow in FIG. 1 to enable the bag body to be in a folded state.

In some possible embodiments, a sealing cavity 1*a* is formed between the inner layer fabric 14 and the outer layer fabric 16, and an air nozzle 1*b*, which communicates with the sealing cavity 1*a*, is arranged on the inner layer fabric 14 or the outer layer fabric 16. Through this air nozzle 1*b*, air can be inflated into the flexible bag body 100, causing the internal unpunctured filling layer 15 to expand and bulge. The outer layer fabric 16 and the inner layer fabric 14 of the punching portion of the filling layer 15 are connected together through hot melting to form a transversely-closed groove a. The inflated and bulged filling layer 15 ensures that the entire flexible bag body 100 stands upright after being inflated. As shown in FIG. 1 and FIG. 2, a transverse long-strip-shaped groove a in the flexible bag body 100 enables the flexible bag body 100 to be pressed and folded from top to bottom. When folding the flexible bag body 100, squeezing the bag body allows the air between the inner layer fabric 14 and the outer layer fabric 16 to be expelled through the air nozzle 1*b*, facilitating the folding process. One of the plurality of grooves a is isolated from the sealing cavity 1*a*, ensuring that the air in the sealing cavity 1*a* does not leak through one of the plurality of grooves a.

It should be noted that, as shown in FIG. 1 to FIG. 15, each groove a on the flexible bag body 100 may include any one or more of a transverse groove, an inclined groove and a longitudinal groove. The directions defined in the present disclosure, such as transverse, inclined, and longitudinal, are determined based on the state of the flexible bag body 100 when it is unfolded and supported on the horizontal supporting surface 400. Specifically, the transverse direction is substantially parallel to the horizontal plane, the inclined direction forms a non-90° angle with the horizontal plane, and the longitudinal direction is perpendicular to the horizontal plane.

Figure 27:
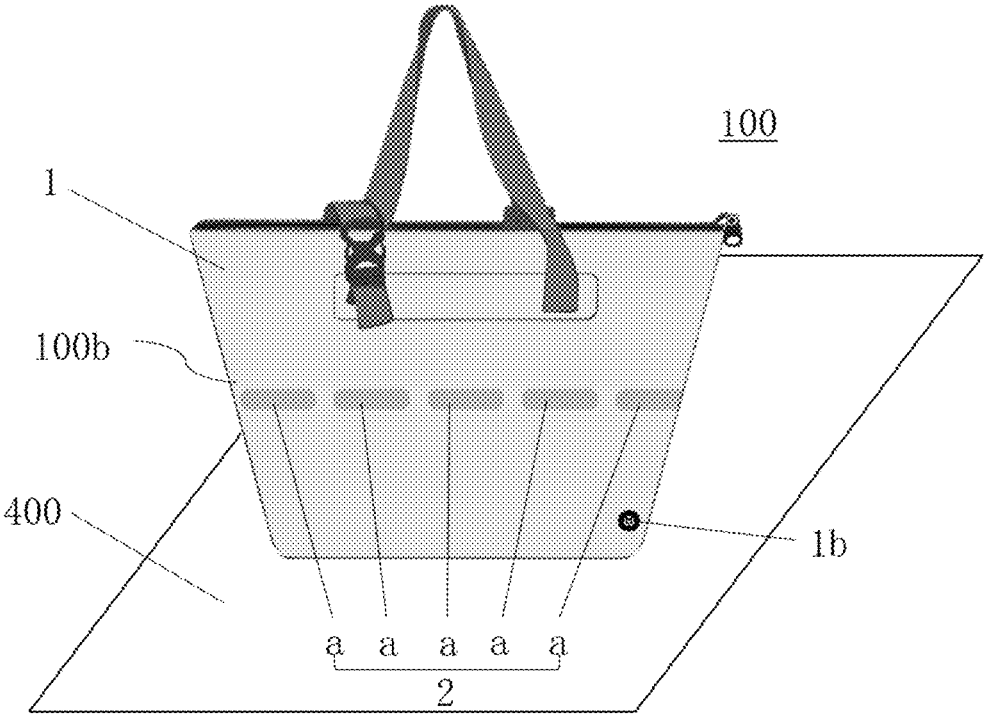
FIG. 27 shows a schematic diagram of another manner of providing a first crease portion on a flexible bag body according to an embodiment of the present disclosure.

In some possible embodiments, as shown in FIG. 1, FIG. 2, and FIG. 27, one of the plurality of crease portions includes a first crease portion 2, and the first crease portion 2 extends in a circumferential direction of the flexible bag body 100. For the embodiment of FIG. 1 and FIG. 2, users can directly press down on the flexible bag body 100 from the top, enabling air to be expelled through the air nozzle 1*b*, while simultaneously allowing the flexible bag body 100 to fold and deform at the first crease portion 2 along its circumference, thereby reducing the height of the flexible bag body 100. The transverse cut diameter of the bag body side walls can be consistent or inconsistent from the bottom to the top opening. For instance, the flexible bag body 100 can have a larger opening at the top, a smaller size in the middle, and a larger size at the bottom. Alternatively, the flexible bag body 100 can be designed with a smaller middle section, a larger bottom, and a smaller opening. Another option is for the flexible bag body 100 to have a larger middle section, a smaller bottom, and a larger opening. The flexible bag body 100 can be designed in various shapes, and the specific shape of the flexible bag body 100 is not limited in the present disclosure. For the embodiment shown in FIG. 27, the flexible bag body 100 is relatively flat, allowing the user to directly fold the upper and lower ends of the flexible bag body 100 along the first crease portion 2 as the folding line for storage, with the air nozzle 1*b* providing exhaust.

Figure 7:
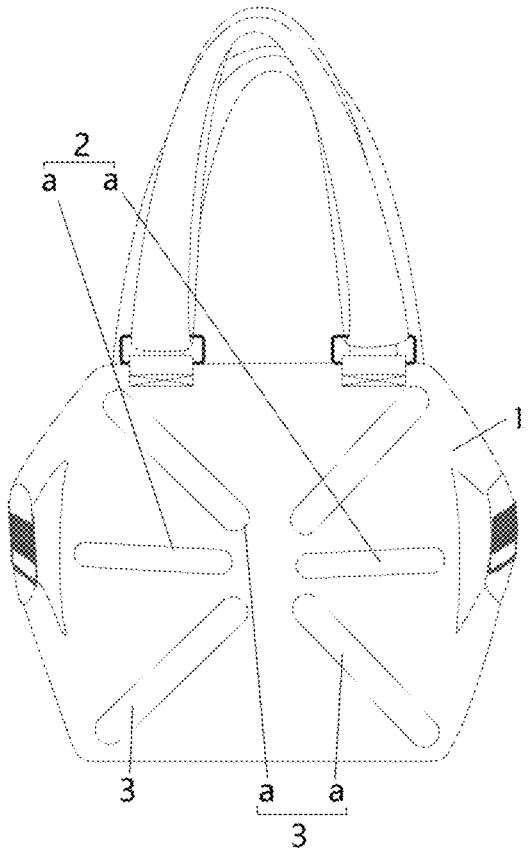
FIG. 7 shows a third structural schematic diagram of providing a first crease portion and a second crease portion on a flexible bag body according to an embodiment of the present disclosure.
Figure 8:
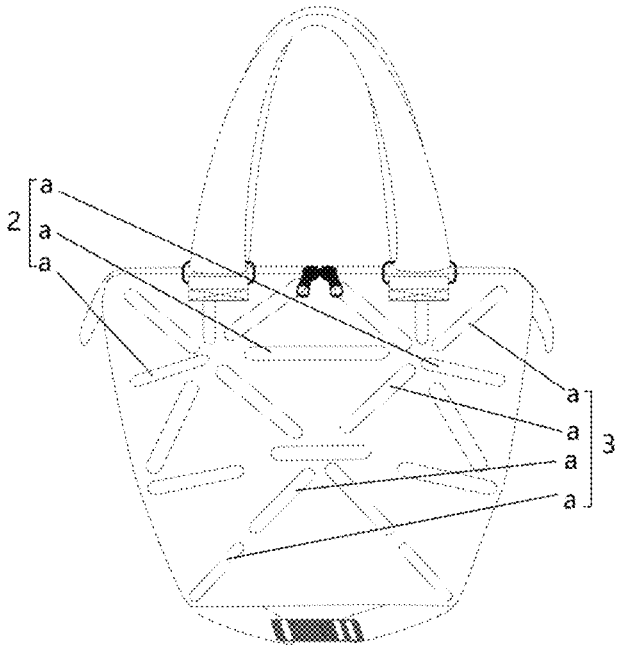
FIG. 8 shows a fourth structural schematic diagram of providing a first crease portion and a second crease portion on a flexible bag body according to an embodiment of the present disclosure.
Figure 9:
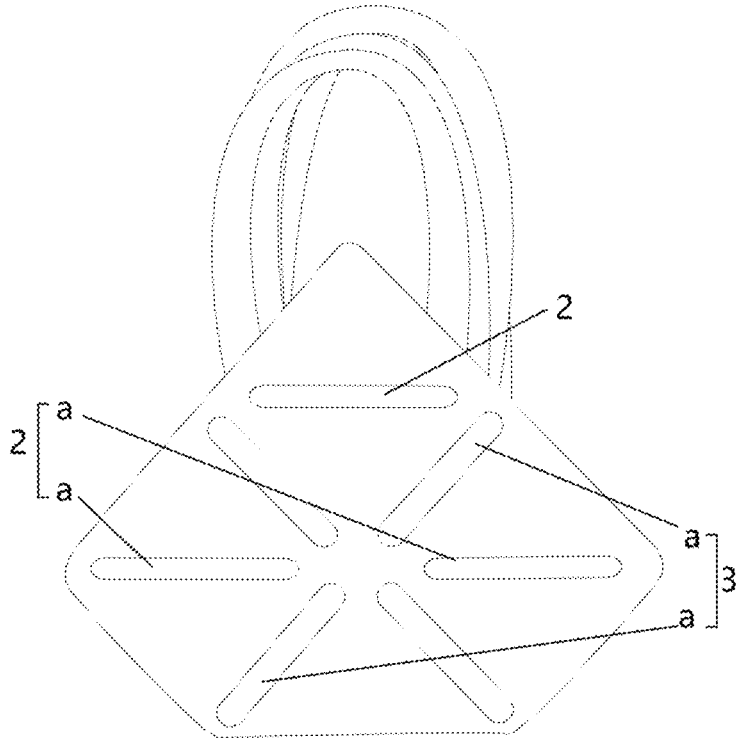
FIG. 9 shows a structural schematic diagram of a flexible bag body according to an embodiment of the present disclosure.
Figure 10:
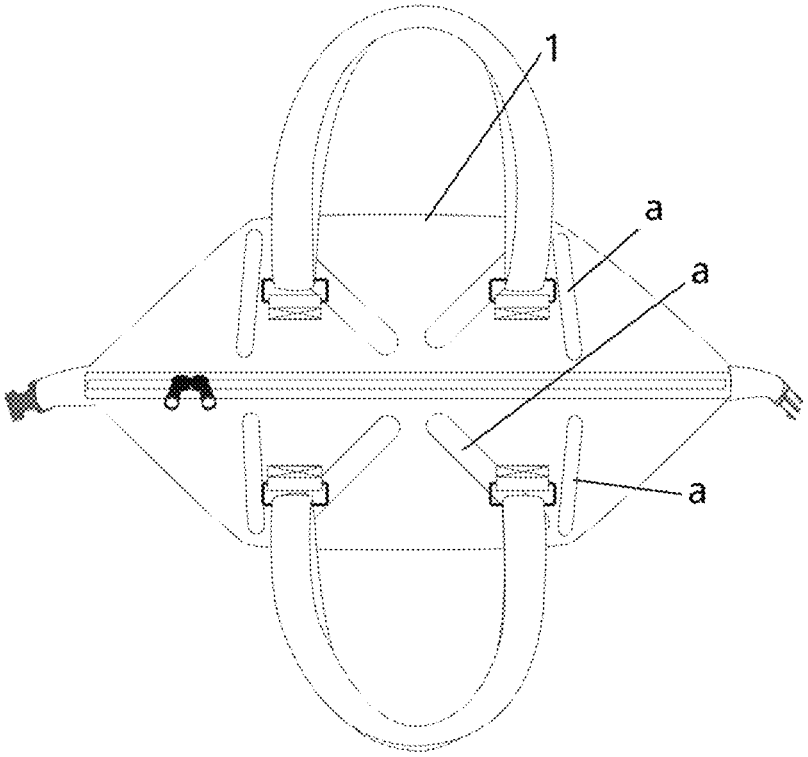
FIG. 10 shows a top view of a flexible bag body in a folded state according to an embodiment of the present disclosure.

In some possible embodiments, the first crease portion 2 comprises a plurality of grooves a which are sequentially arranged at intervals, and connecting lines of all the grooves a form an annular closed crease line. The length of each groove a can be greater than the distance between adjacent grooves a, thereby rendering the crease line less rigid around its circumference and making it easier to bend and deform as a whole when subjected to force. Each groove a can be a transverse groove, as shown in FIG. 1 and FIG. 9. Alternatively, each groove a can be a slightly inclined groove, as shown in FIG. 7 and FIG. 8.

In some possible embodiments, as shown in FIG. 1, when the flexible bag body 100 is in the unfolded state, each of the plurality of grooves a is located in the same plane. All the grooves a, located in the same plane, divide the bag body into two regularly shaped parts: an upper and a lower part. This design allows the entire upper part to be retracted into the inner side of the lower part or sleeved on the outer side of the lower part, creating an inner-outer nested folding effect for the flexible bag body 100.

In some possible embodiments, as shown in FIG. 4 to FIG. 9, one of the plurality of crease portions may include a plurality of second crease portions 3, one of the plurality of second crease portions 3 extends obliquely. When the flexible bag body is in the unfolded state and is supported on the horizontal supporting surface, an included angle is formed between one of the plurality of second crease portions and the horizontal supporting surface. One of the plurality of second crease portions 3 forms an included angle with the first crease portion 2. One of the plurality of second crease portions 3 intersects with the first crease portion 2, this increases the folding areas of the flexible bag body 100, the flexible bag body 100 can be folded inward at the first crease portion 2 and outward at one of the plurality of second crease portions 3, allowing the upper and lower parts of the flexible bag body 100 to fold together. This results in a flatter and more compact folded form for the flexible bag body 100.

In some possible embodiments, as shown in FIG. 4 to FIG. 9, at least two intersecting second crease portions 3 are respectively arranged on the two opposite side pieces 1 of the flexible bag body 100, and four end portions of the two intersecting second crease portions 3 respectively extend away from each other and extend towards two sides of the upper portion and two sides of the lower portion, respectively, for example, extending towards the two sides of the top of the side piece 1 and the two sides of the bottom of the side piece 1. The first crease portion in the middle of the side piece 1 can be transversely folded inwards, the two intersecting second crease portions 3 can be folded outwards to form edges, and the intersecting second crease portions 3 are located on the same straight line in the folded state, so that the flexible bag body 100 is folded more flat, thus facilitating storage. It should be noted that the terms "above" and "below" in the present disclosure should be understood as referring to the upper portion and the lower portion of the flexible bag body when the flexible bag body is supported on the horizontal supporting surface.

As shown in FIG. 20 to FIG. 23, the flexible bag body 100 comprises a cover piece, a bottom piece and four side pieces 1, the four side pieces 1 enclose to form a cavity 100*a*, a top opening and a bottom opening, the bottom piece is connected to each side piece 1 to close the bottom opening, and the cover piece can be connected to the side piece 1 for closing or opening the top opening. The flexible bag body is provided with a first crease portion 2, and all strip-shaped grooves a of the first crease portion 2 are sequentially arranged in the circumferential direction of the flexible bag body 100. Two intersecting second crease portions 3 are respectively arranged on the two opposite side pieces 1 of the flexible bag body 100, and four end portions of the two intersecting second crease portions 3 respectively extend away from each other and extend towards two sides of the upper portion and two sides of the lower portion, respectively, for example, extending towards the two sides of the top of the side piece 1 and the two sides of the bottom of the side piece 1. The flexible bag body 100 also comprises an inner layer fabric, a filling layer and an outer layer fabric, and the flexible bag body 100 is provided with an air nozzle 1*b*. Consumers can directly press down on the flexible bag body 100 from the top, allowing the air between the inner layer fabric and the outer layer fabric to be expelled through the air nozzle 1*b*. At the moment, the flexible bag body 100 will fold along the first crease portion 2, while the two opposite side pieces are bent at the intersecting second crease portions 3. Ultimately, the whole flexible bag body 100 is folded to form a flat structure, thus facilitating storage.

Figure 23:
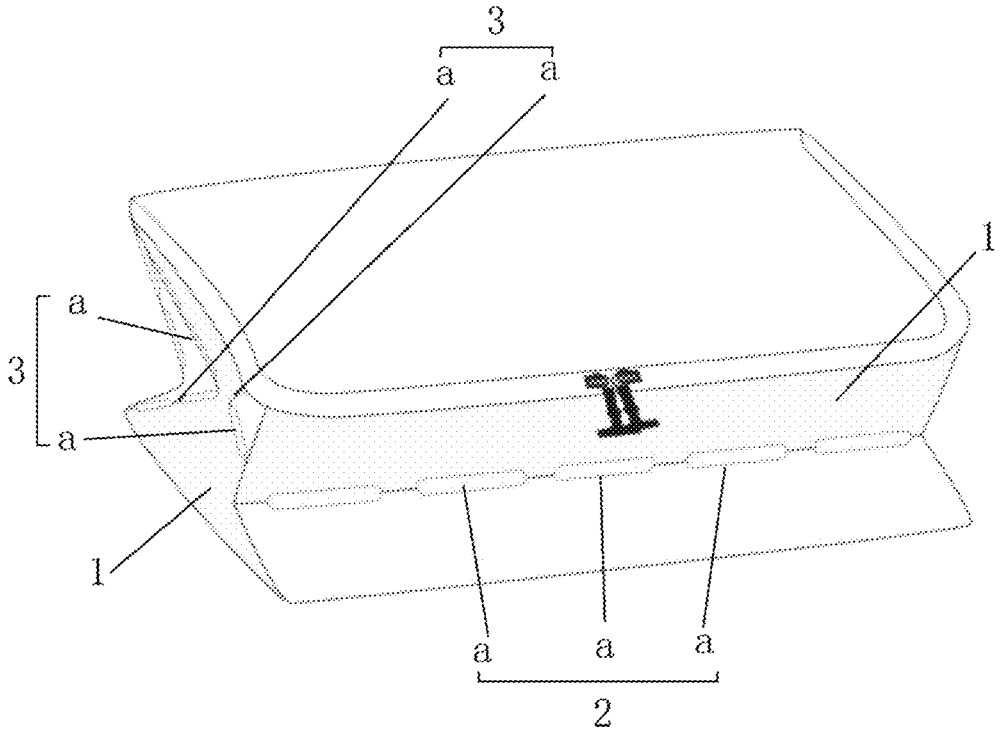
FIG. 23 shows a schematic diagram of another folding mode of the flexible bag body in FIG. 20.

For instance, referring to the flexible bag body 100 shown in FIG. 23, the flexible bag body 100 comprises a cover piece, a bottom piece and four side pieces 1, the four side pieces 1 enclose to form a cavity, a top opening and a bottom opening, the bottom piece is connected to each side piece 1 to close the bottom opening, and the cover piece can be connected to the side piece 1 for closing or opening the top opening. A first crease portion is arranged in the middle of the two opposite side pieces 1, and is only arranged on the two opposite side pieces 1. Two intersecting second crease portions 3 are arranged on the two opposite side pieces 1 of the flexible bag body 100, and four end portions of the two intersecting second crease portions 3 respectively extend away from each other and extend towards two sides of the upper portion and two sides of the lower portion, respectively, for example, extending towards the two sides of the top of the side piece 1 and the two sides of the bottom of the side piece 1. The flexible bag body 100 also comprises an inner layer fabric, a filling layer and an outer layer fabric, and the flexible bag body is provided with an air nozzle. Consumers can directly press down on the flexible bag body 100 from the top, allowing the air between the inner layer fabric and the outer layer fabric to be expelled through the air nozzle. At the moment, the flexible bag body 100 can be folded in the first crease portion 2 on the two side pieces 1, meanwhile, the second crease portion 3 on the other two side pieces 1 is folded inwards, the whole flexible bag body 100 is finally folded to form a flat structure, thus facilitating storage.

Figure 4:
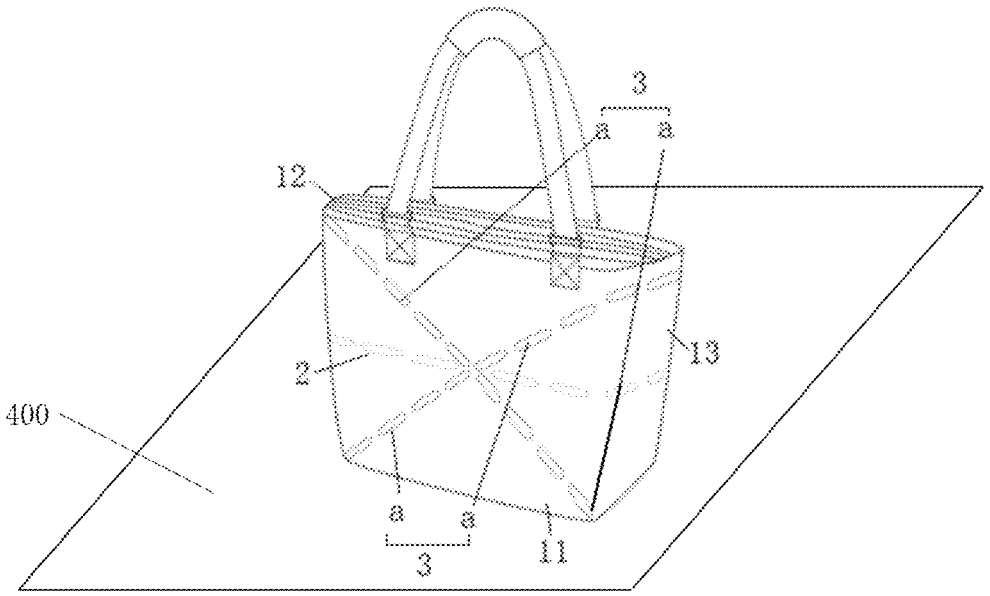
FIG. 4 shows a state diagram in the process of pressing the flexible bag body in the direction indicated by the arrow in FIG. 3.
Figure 5:
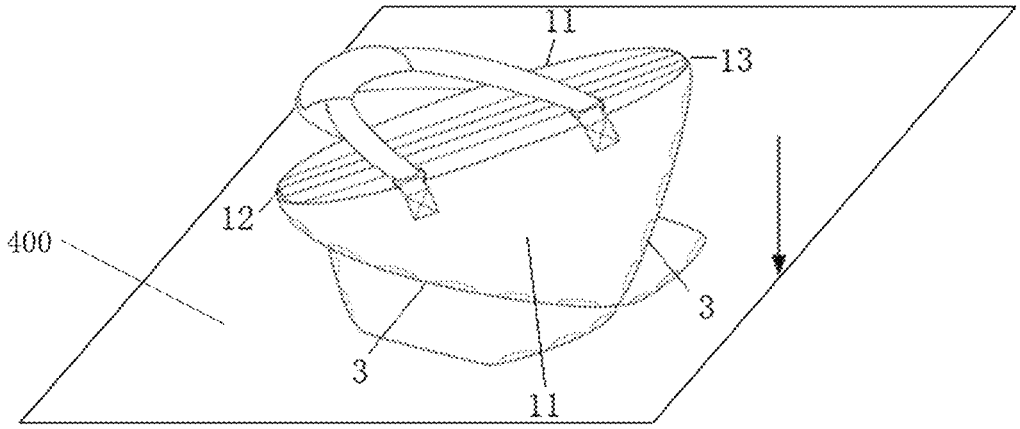
FIG. 5 shows a schematic diagram of pressing the flexible bag body in the direction indicated by the arrow in FIG. 3 to enable the flexible bag body to be in a folded state.
Figure 6:
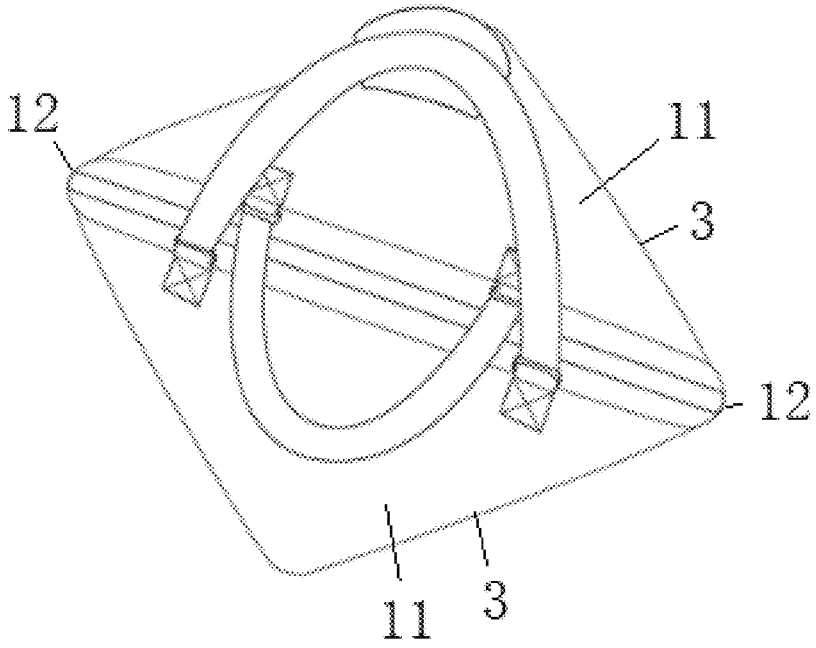
FIG. 6 shows a second structural schematic diagram of providing a first crease portion and a second crease portion on a flexible bag body according to an embodiment of the present disclosure.

In some possible embodiments, as shown in FIG. 4 to FIG. 6, the flexible bag body 100 comprises two first side pieces 11, a second side piece 12 and a third side piece 13; the second side piece 12 and the third side piece 13 are arranged on two sides of one of the two first side pieces 11 respectively, and the second side piece 12 and the third side piece 13 are connected to the two first side pieces 11 respectively; and two intersecting second crease portions 3 are arranged on the two first side pieces 11, wherein one end of one of the two intersecting second crease portions 3 extends to a midpoint or a top end point of a top of the second side piece 12, and another end of one of the two intersecting second crease portions 3 extends to a midpoint or a bottom end point of a bottom of the third side piece 13; one end of another one of the two intersecting second crease portions 3 extends to a midpoint or a top end point of a top of the third side piece 13, and another end of another one of the two intersecting second crease portions 3 extends to a midpoint or a bottom end point of a bottom of the second side piece 12.

The crease portion extends to the second side piece 12 and the third side piece 13 of the flexible bag body 100, enabling all side pieces 1 of the flexible bag body 100 to fold synchronously. The bending parts are entirely composed of the plurality of crease portions arranged on the flexible bag body 100, without forming creases on other parts. This minimizes folding resistance, reduces folding difficulty, and enhances folding efficiency.

In some possible embodiments, as shown in FIG. 12 to FIG. 15, the crease portion comprises a plurality of third creases 4. The plurality of third creases 4 are sequentially arranged at intervals in the circumferential direction of the flexible bag body 100. Each third crease 4 forms an included angle with the first crease portion 2. The flexible bag body 100 can be rotationally folded along the inclined direction of each third crease to reduce its height. It should be noted that only the third crease portion 4 can be arranged on the flexible bag body provided by the embodiment of the present disclosure, and the first crease portion 2 is not arranged.

Each third crease 4 can also comprise a plurality of inclined long-strip-shaped grooves a, and the grooves a are sequentially arranged at intervals. When the flexible bag body 100 is in the unfolded state, each groove a of the same third crease 4 can be located on the same straight line. When the flexible bag body 100 is rotated, it synchronously bents and deforms at each crease portion. And finally, the top surface and the bottom surface of the bag body gradually approach each other until the distance between them is less than a set value.

In some possible embodiments, the flexible bag body 100 comprises a plurality of side pieces 1, and each side piece 1 is provided with at least one third crease 4. As shown in FIG. 12 to FIG. 15, the flexible bag body 100 may be provided with four side pieces 1, and the adjacent side pieces 1 are perpendicular. The flexible bag body 100 is roughly cubic. A third crease 4 is arranged on each side piece 1, and the two ends of the third crease 4 extend towards the two ends of the diagonal line of the side piece 1 respectively. By rotating the flexible bag body 100 forwardly, the side piece 1 is folded and deformed, reducing the height of the flexible bag body 100. Reversely rotating the top cover of the flexible bag body 100 restores the side piece 1 to its original shape and gradually unfolds it.

In some possible embodiments, the third crease 4 is provided on one or both sides of the first crease portion 2 in the height direction.

The flexible bag body 100 is provided with a first crease portion 2 and a second crease portion 3 respectively, so that part of its structure can be telescopically folded and another part can be folded through rotation, further reducing the folding volume of the flexible bag body 100. In the process of folding the flexible bag body 100, part of its structure can first be folded through rotation, and then by pressing down on the flexible bag body 100, it can be folded into a pad-like shape, thus facilitating easy storage.

In some possible embodiments, the third crease 4 and the first crease portion 2 are sequentially and alternately arranged in the height direction of the flexible bag body 100. When the height of the flexible bag body 100 is relatively high, a plurality of first crease portions 2 and a plurality of groups of third creases 4 can be arranged on the flexible bag body 100, with the first crease portion 2 and the third crease 4 being sequentially and alternately arranged in the height direction, so that a relatively high flexible bag body 100 can be folded to a relatively small height. When specifically folding the flexible bag body 100, a part of its structure can first be rotated and folded, and then the flexible bag body 100 is pressed down, bringing each part of the structure after rotary folding closer together vertically. Finally, all parts of the structure are nested inside and outside, allowing the higher bag body to form a flat folding state and minimizing the height size of the flexible bag body 100 to the greatest extent possible.

Figure 11:
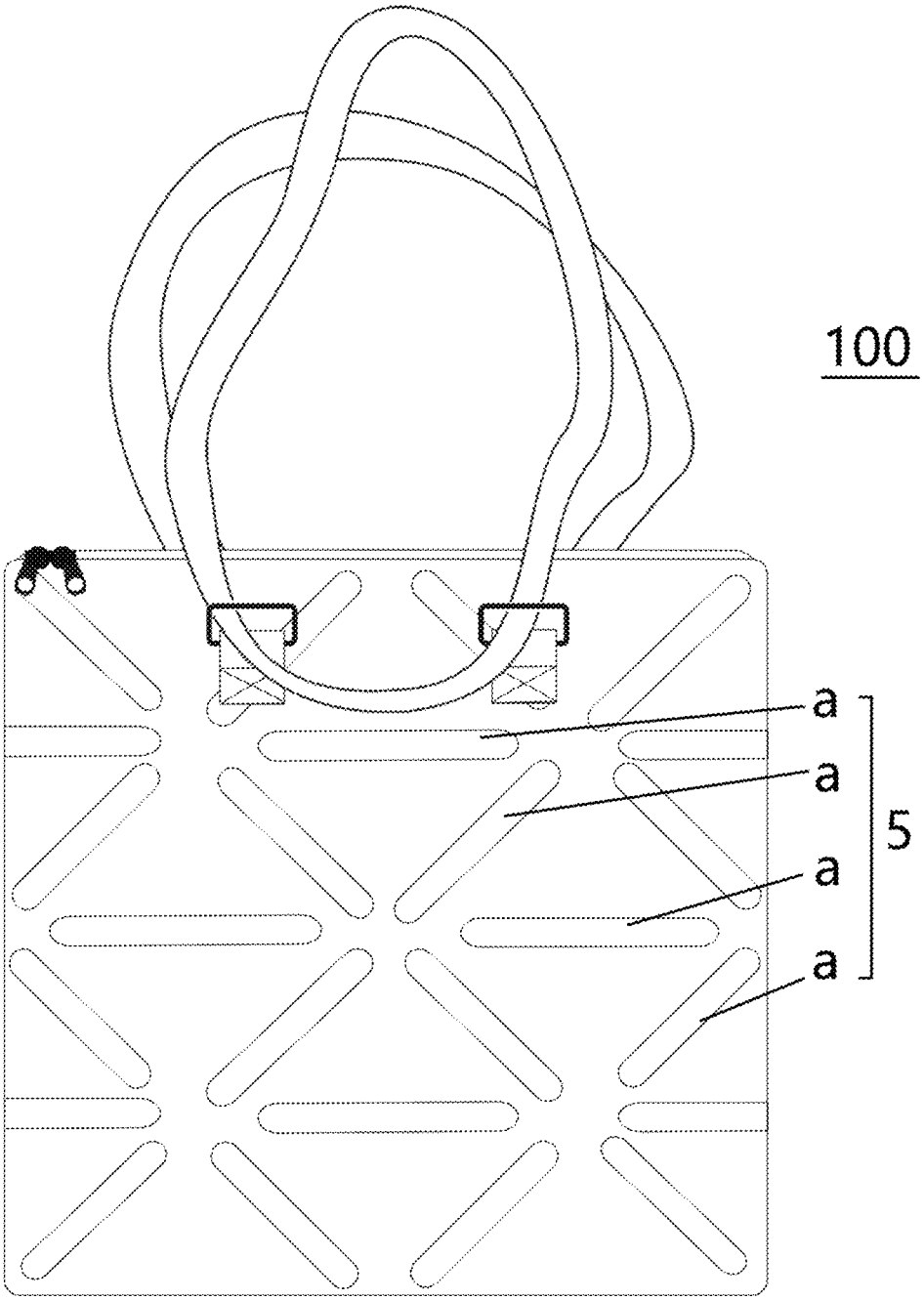
FIG. 11 shows a structural schematic diagram of providing a fourth crease portion on a flexible bag body according to an embodiment of the present disclosure.
Figure 12:
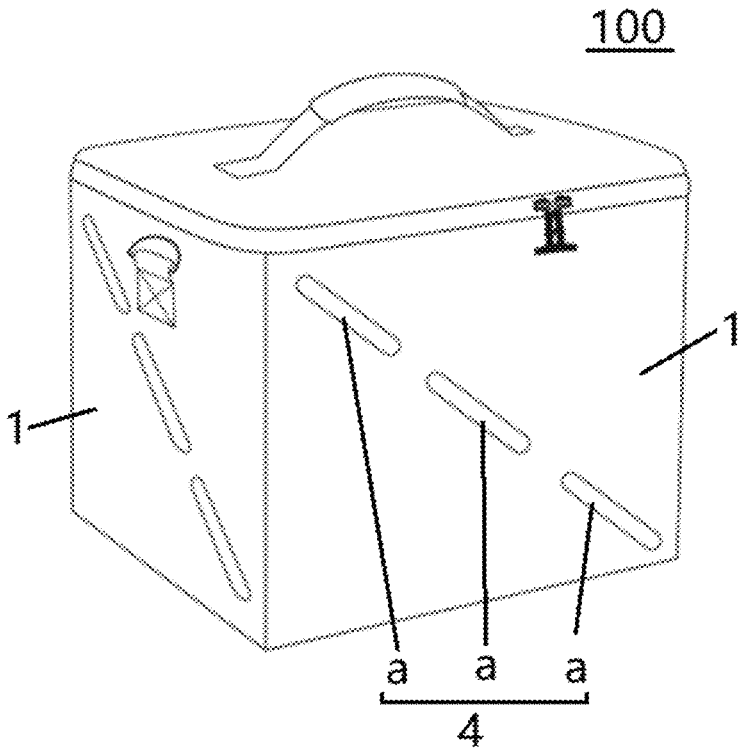
FIG. 12 shows a three-dimensional schematic diagram of a flexible bag body in an unfolded state according to an embodiment of the present disclosure.
Figure 13:
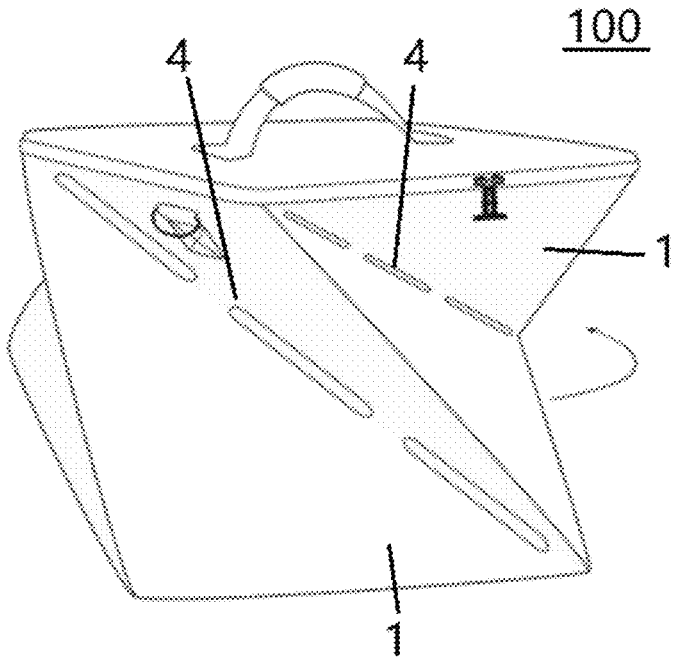
FIG. 13 shows a middle state diagram of a flexible bag body rotated and folded according to an embodiment of the present disclosure.
Figure 14:
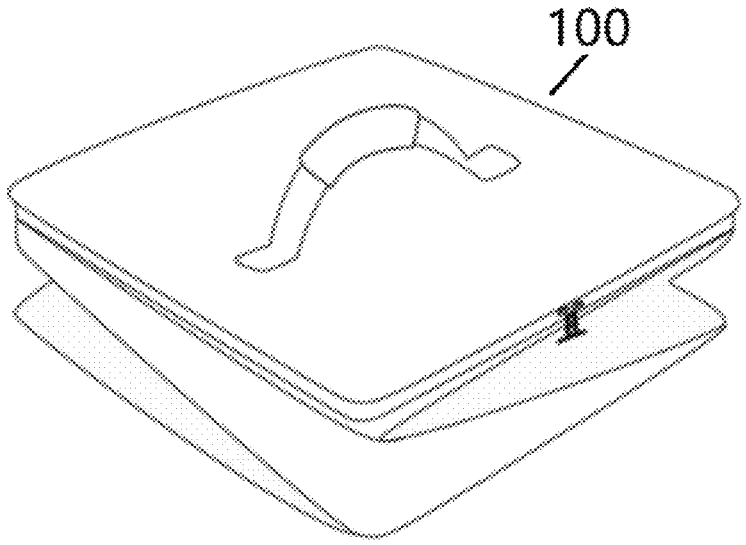
FIG. 14 shows a schematic diagram of a flexible bag body being completely rotated to a folded state according to an embodiment of the present disclosure.
Figure 15:
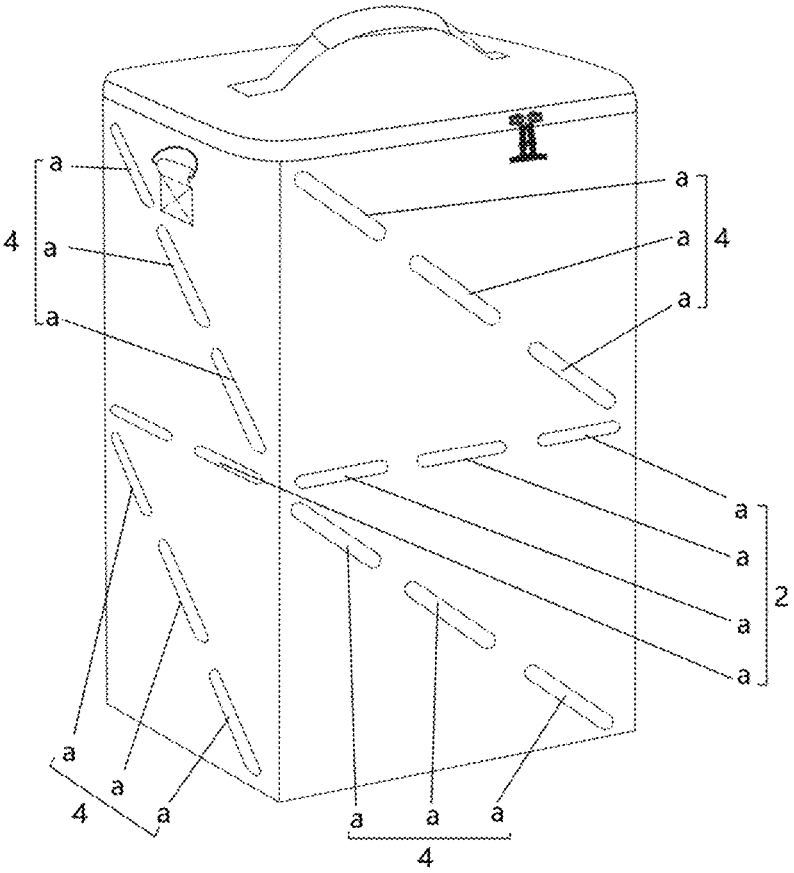
FIG. 15 shows a structural schematic diagram of providing a first crease portion and a third crease portion on a flexible bag body according to an embodiment of the present disclosure.

In some possible embodiments, as shown in FIG. 11, one of the plurality of crease portions includes a fourth crease portion 5, the fourth crease portion 5 is distributed on a whole surface of the flexible bag body 100, and a plurality of triangular areas are formed between the fourth crease portions 5, thus allowing the flexible bag body 100 to be provided with a plurality of different folded states. The fourth crease portion 5 comprises a plurality of long-strip-shaped grooves a, each groove a serving as one edge of a triangular area, which can be an isosceles triangle. With these regularly distributed grooves a, users can customize the shape of the bag according to their needs. In the unfolded state, the flexible bag body 100 can be in a one-piece state and can be used as an outdoor temporary cushion. Moreover, the entire bag body is made from a single, square piece of material, avoiding any waste of fabric and making it more material-efficient.

Figure 28A:
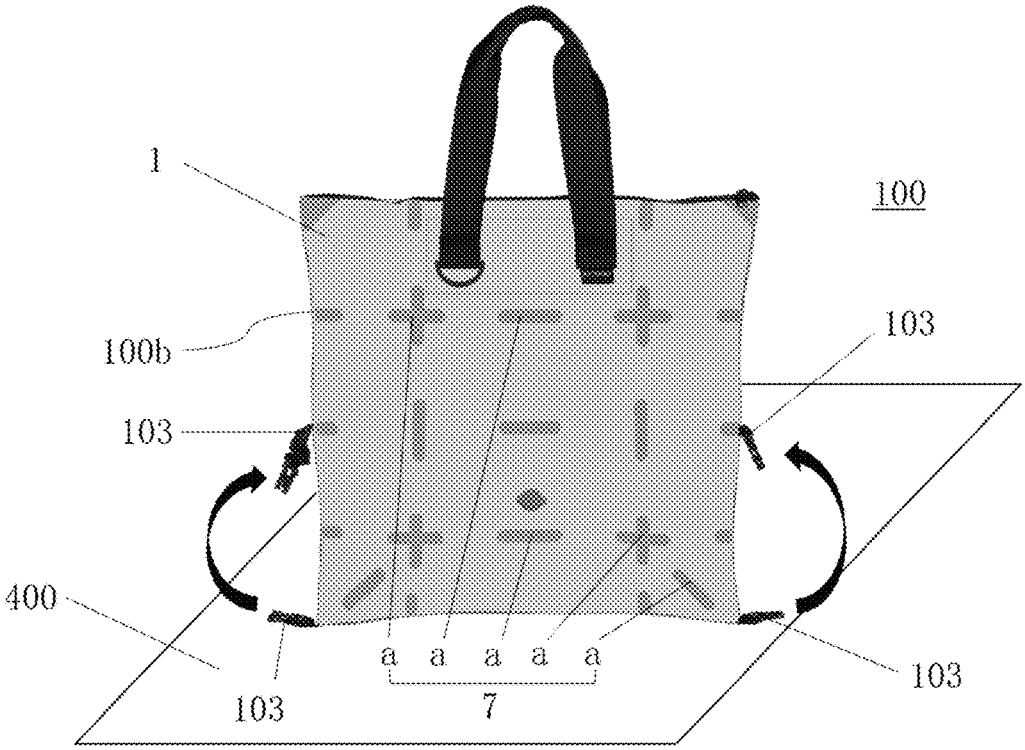
FIG. 28*a* shows a structural schematic diagram of providing a fifth crease portion on a flexible bag body according to an embodiment of the present disclosure.

In some possible embodiments, as shown in FIG. 28*a*, one of the plurality of crease portions comprises a fifth crease portion 7, the fifth crease portion 7 is distributed on the whole surface of the flexible bag body 100, a plurality of fifth crease portions 7 are arranged, the plurality of fifth crease portions 7 are parallel to the horizontal supporting surface 400, the plurality of fifth crease portions 7 are perpendicular to the horizontal supporting surface 400, and a plurality of rectangular areas are formed between the fifth crease portions 7. The flexible bag body 100 is provided with a plurality of different folded states. The flexible bag body 100 can be folded in half along one of the plurality of fifth crease portions 7 in either the horizontal or vertical direction.

Figure 28B:
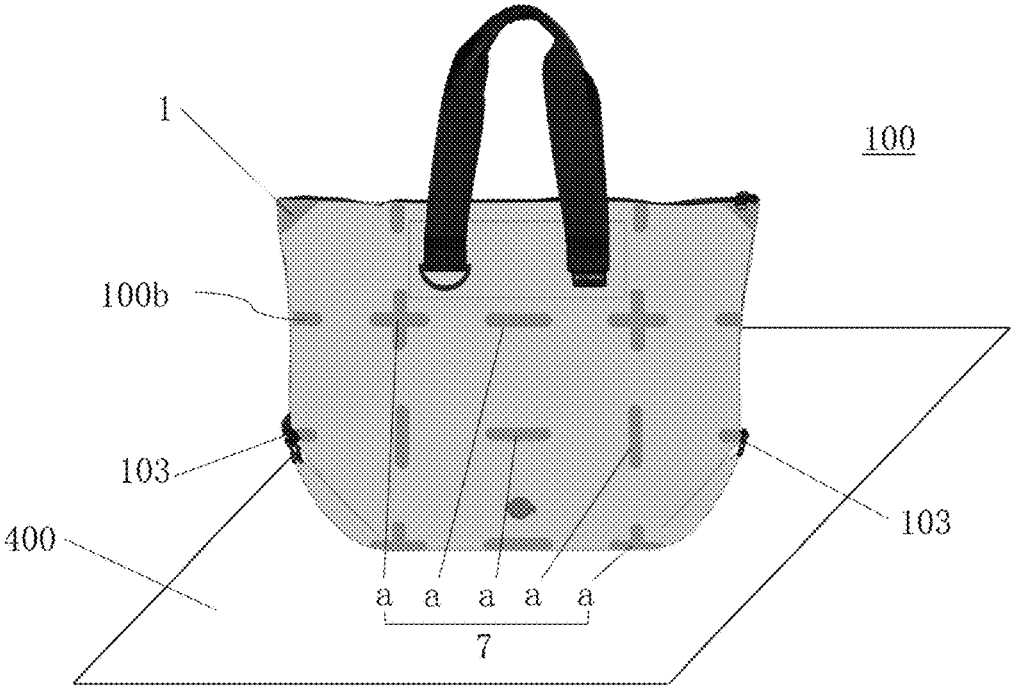
FIG. 28*b* shows a structural schematic diagram of the flexible bag body in FIG. 28*a* after the fixing piece is connected according to an arrow.

In some possible embodiments, as shown in FIG. 28*a*, two ends of a bottom of the flexible bag body 100 further comprise a fifth crease portion 7 that forms an included angle with the horizontal supporting surface 400, and fixing pieces 103 matched with each other are arranged at the two ends of the bottom of the flexible bag body 100 and two ends of a waist portion of the flexible bag body 100. By connecting the fixing pieces 103 at the bottom with the corresponding fixing pieces 103 at the waist, the shape of the bag body can be altered, as shown in FIG. 28*b* after the shape change. The fixing pieces 103 can be implemented using buckles, buttons, hook-and-loop fasteners, straps, or other similar means.

Figure 16:
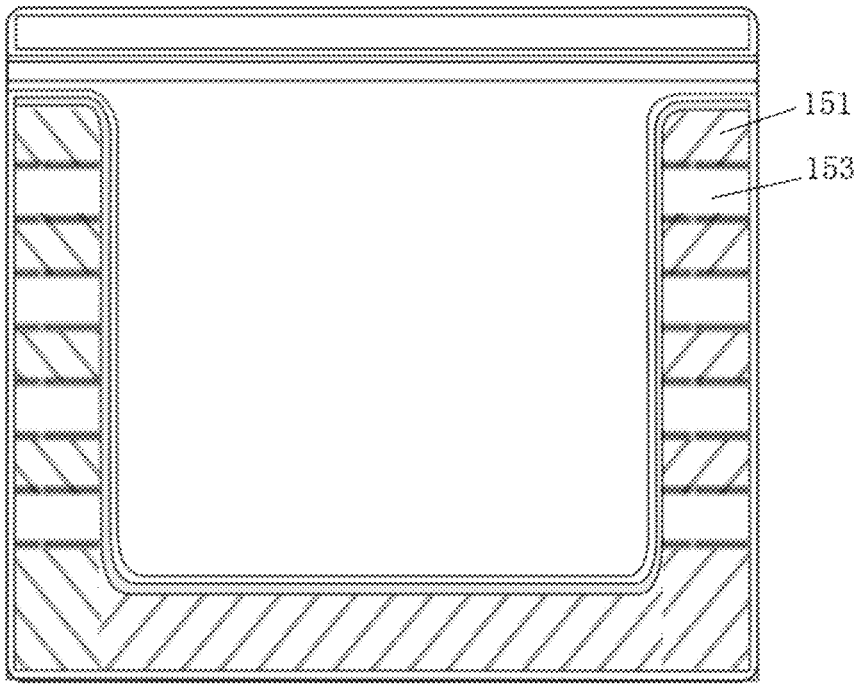
FIG. 16 shows a cross-sectional view of a flexible bag body according to an embodiment of the present disclosure.
Figure 26:
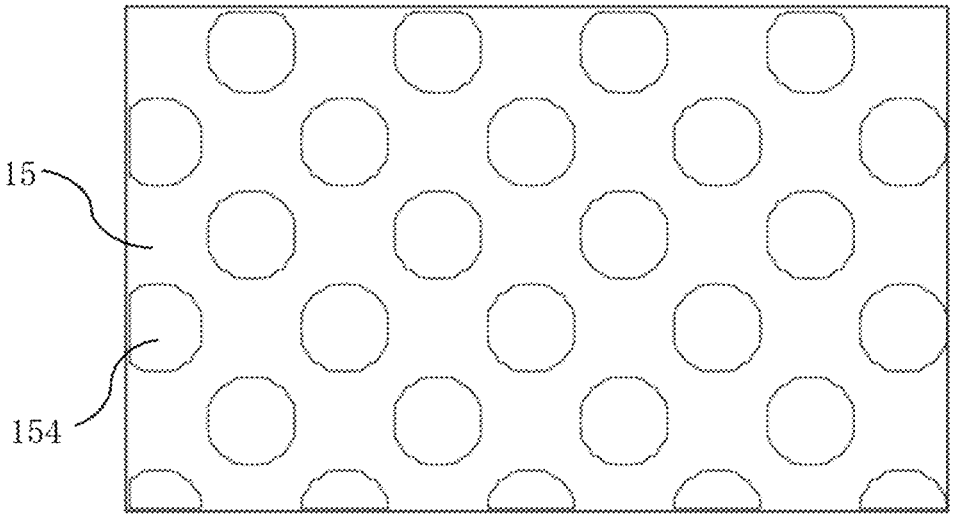
FIG. 26 shows a schematic diagram of providing a through hole on a filling layer of a flexible bag body according to an embodiment of the present disclosure.

In some possible embodiments, as shown in FIG. 3 and FIG. 16, the filling layer 15 can be made of materials such as sponge 151, Ethylene Vinyl Acetate (EVA), rubber and plastic insulation materials, silicon dioxide aerogel felt, and the like. To enhance heat preservation and maintain dryness, the filling layer 15 can comprise a sponge 151 and a composite sheet 152. The sponge 151 and the composite sheet 152 are bonded and fixed, and the composite sheet 152 can be either or both of an aluminum foil sheet and an EVA sheet. To enhance heat preservation while also saving costs, the sponges 151 with different expansion ratios can be bonded together or the sponge 151 can be bonded with other materials with low thermal conductivity. The filling layer 15 can undergo processes such as punching and wire cutting, making the flexible bag body lightweight, easily compressed, and compact, and enabling the surface of the flexible bag body to exhibit various textures. For example, as shown in FIG. 26, a plurality of through holes 154 can be formed in the filling layer 15. Each through hole 154 needs to be hollowed out on the filling layer 15. The weight of the flexible bag body can be greatly reduced by having a sufficient number of the through holes 154.

Figure 17:
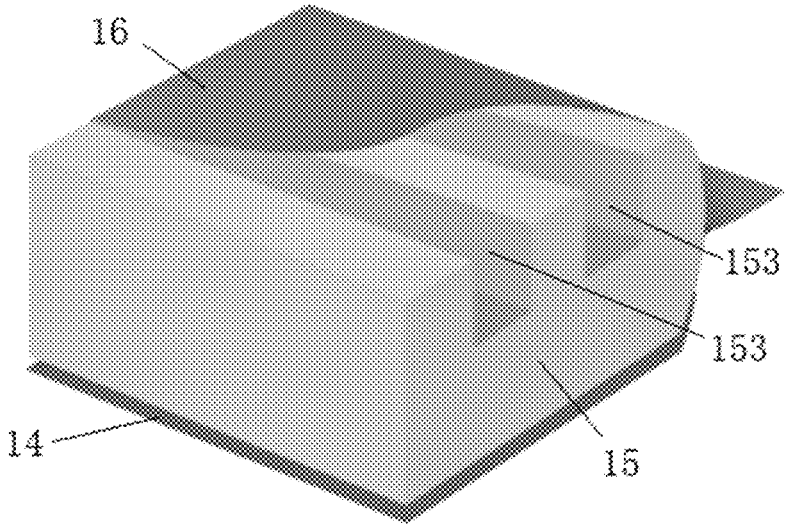
FIG. 17 shows a schematic diagram of forming a hole portion by means of linear cutting of a filling layer of a flexible bag body according to an embodiment of the present disclosure.
Figure 18:
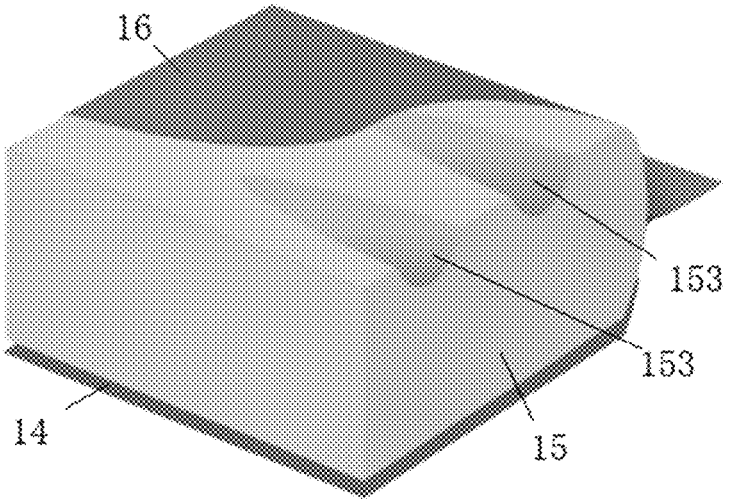
FIG. 18 shows a schematic diagram of forming a hole portion by means of hole digging of a filling layer of a flexible bag body according to an embodiment of the present disclosure.

Currently, most of the soft cooler bags available in the market use thicker fabrics, typically made of abrasion-resistant and waterproof materials such as polyester or Oxford cloth, to protect the internal filling and items requiring insulation. The internal filling also employs relatively stiff and thick materials, resulting in a common issue where these bags have a certain weight. When filled with food, their weight significantly increases, making them inconvenient to carry and occupying substantial space when not in use. Therefore, a lightweight and foldable self-inflating flexible bag body 100 can address this problem. As shown in FIG. 17 and FIG. 18, the filling layer 15 of the flexible bag body 100 provided by the embodiment of the present disclosure can be provided with a plurality of hole portions 153. In the unfolded state, the outer layer fabric 16 forms an outer convex pattern at one of the plurality of hole portions. The hole portions 153 can be created through punching or wire cutting processes, making the flexible bag body 100 lightweight, easily compressible, and compact. Additionally, this design gives the flexible bag body 100 a textured surface with different styles. Compared to the manufacturing processes available in the market, the flexible bag body 100 of the present disclosure is more portable, easier to fold, more compact, and maintains insulation performance without increasing costs.

The conventional cooler bags in the market are relatively expensive and overly specialized. The flexible bag body 100 provided by the embodiment of the present disclosure is priced moderately, offers insulation, and is relatively lightweight, making it suitable for daily shopping as well as for light outdoor enthusiasts. It has a broader market and a wider audience.

Zippers 6, hook-and-loop fasteners, buckles, or other connecting structures can be arranged on both sides of the opening of the flexible bag body 100 to close or open the opening. Handles can be provided on the flexible bag body 100 for convenient standalone use, and the flexible bag body 100 can also be used in conjunction with other carriers.

As shown in FIG. 19*a* to FIG. 19*d*, the embodiment of the present disclosure further provides a cooler bag. The cooler bag comprising a cooler bag housing 200 and the aforementioned flexible bag body 100, and the flexible bag body 100 is detachably connected to the cooler bag housing 200. The cooler bag housing 200 facilitates user portability and serves to protect the flexible bag body 100.

Figure 19A:
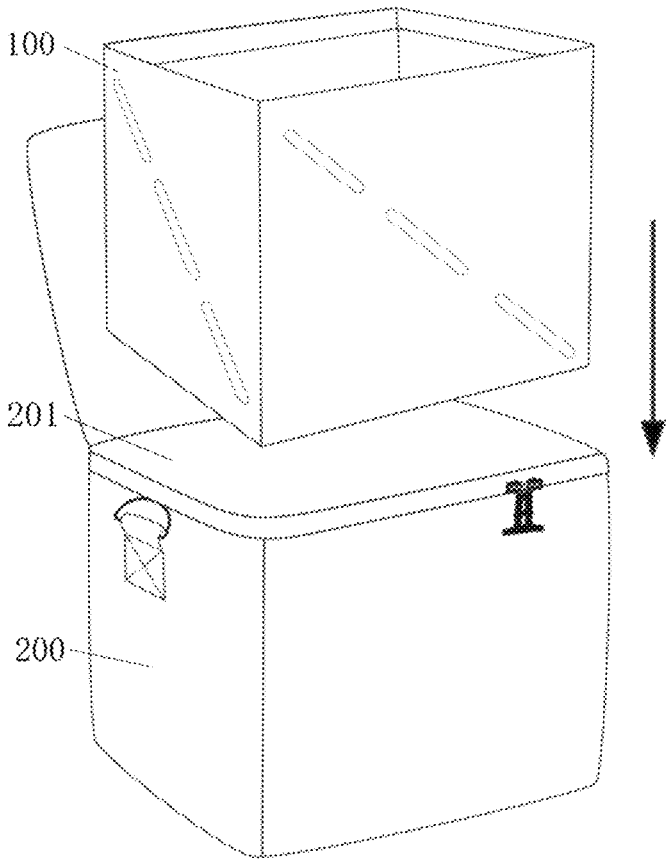
FIG. 19*a* shows a structural schematic diagram of a cooler bag according to an embodiment of the present disclosure.

The cooler bag housing 200 and the flexible bag body 100 are matched in any one of the following modes:

In the first matching mode, as shown in FIG. 19*a*, the cooler bag housing 200 is provided with an accommodating cavity 201, and the flexible bag body 100 can be accommodated in the accommodating cavity 201. Under this configuration, the flexible bag body 100 serves as an inner container. When insulation is required for the cooler bag, the inner container is added; for ordinary storage purposes, only the cooler bag housing 200 is used. Moreover, if the cooler bag housing 200 is damaged, only the cooler bag housing 200 can be replaced, and if the inner container is damaged, only the inner container can be replaced. This allows for repeated use and extends the product's service life, thereby minimizing waste.

Figure 19B:
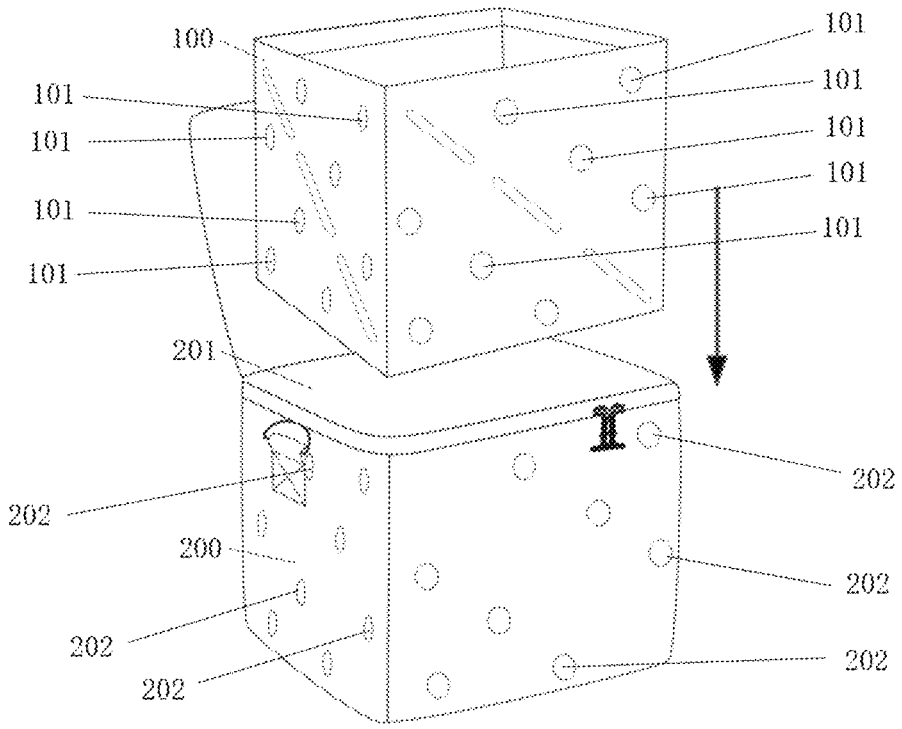
FIG. 19*b* shows a structural schematic diagram of a cooler bag connected by using a magnetic attraction component according to an embodiment of the present disclosure.

In the second matching mode, as shown in FIG. 19*b*, the cooler bag housing 200 is provided with a first magnetic attraction portion 202, the flexible bag body 100 is provided with a second magnetic attraction portion 101, and the first magnetic attraction portion 202 and the second magnetic attraction portion 101 are magnetically attracted to each other. The magnetic attraction method is simple in structure and easy to operate. The flexible bag body 100 can be placed either inside or outside the cooler bag housing 200, as long as it does not fall off.

Figure 19C:
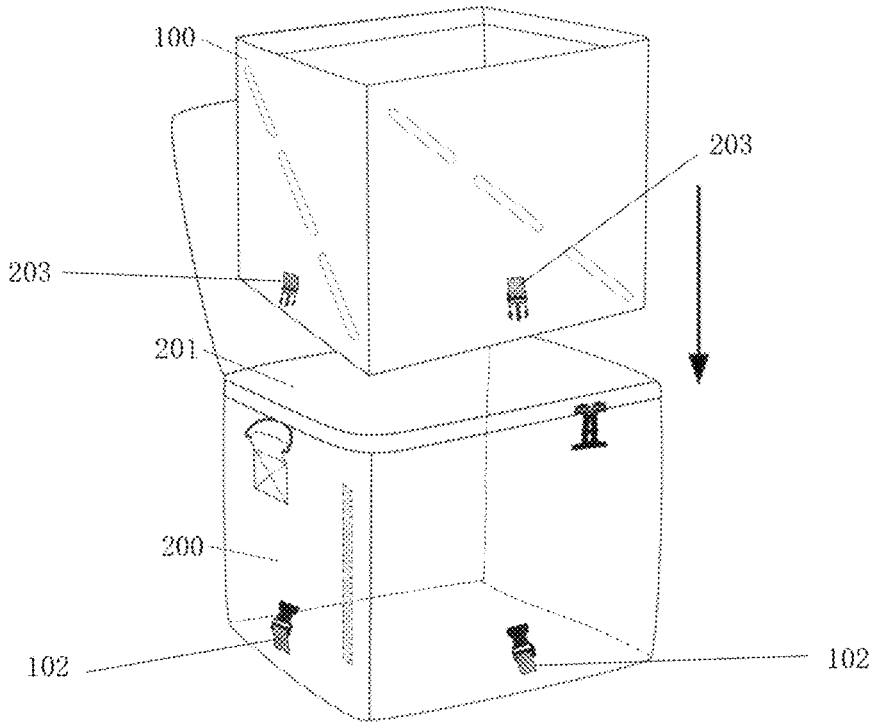
FIG. 19*c* shows a structural schematic diagram of a cooler bag connected by using a buckle according to an embodiment of the present disclosure.

In the third matching mode, as shown in FIG. 19*c*, the cooler bag housing 200 is provided with a first buckle 102, the flexible bag body 100 is provided with a second buckle 203, and the first buckle 102 and the second buckle 203 are clamped and fixed. In the embodiment, the cooler bag housing 200 and the flexible bag body 100 are clamped and fixed by a buckle structure, which has the advantages of stable and reliable connection. The flexible bag body 100 can be placed either inside or outside the cooler bag housing 200, as long as it does not fall off.

Figure 19D:
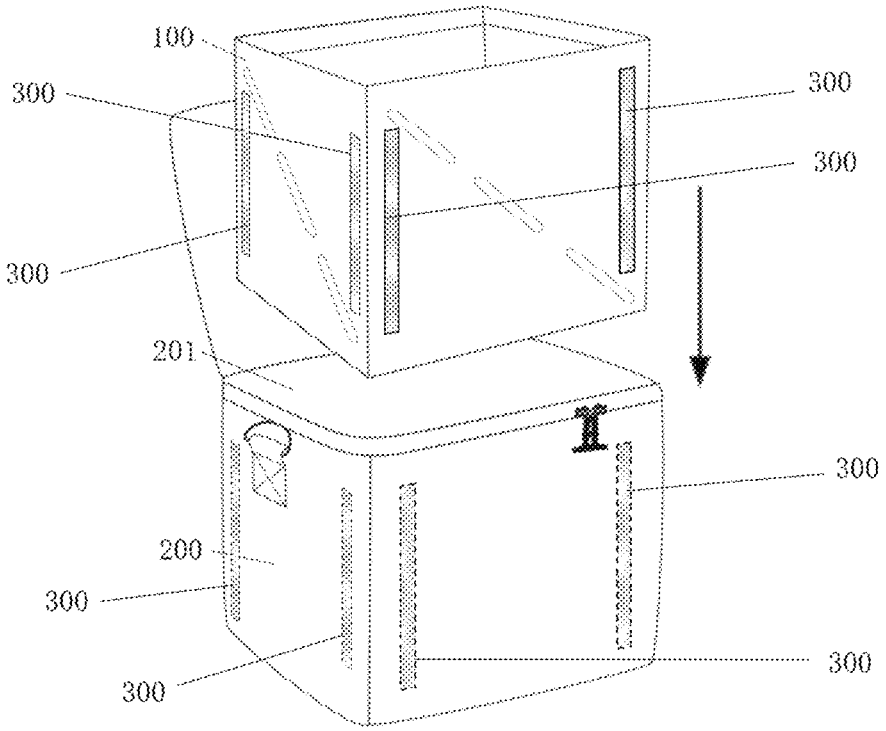
FIG. 19*d* shows a structural schematic diagram of a cooler bag connected by using a hook-and-loop fastener according to an embodiment of the present disclosure.
Figure 20:
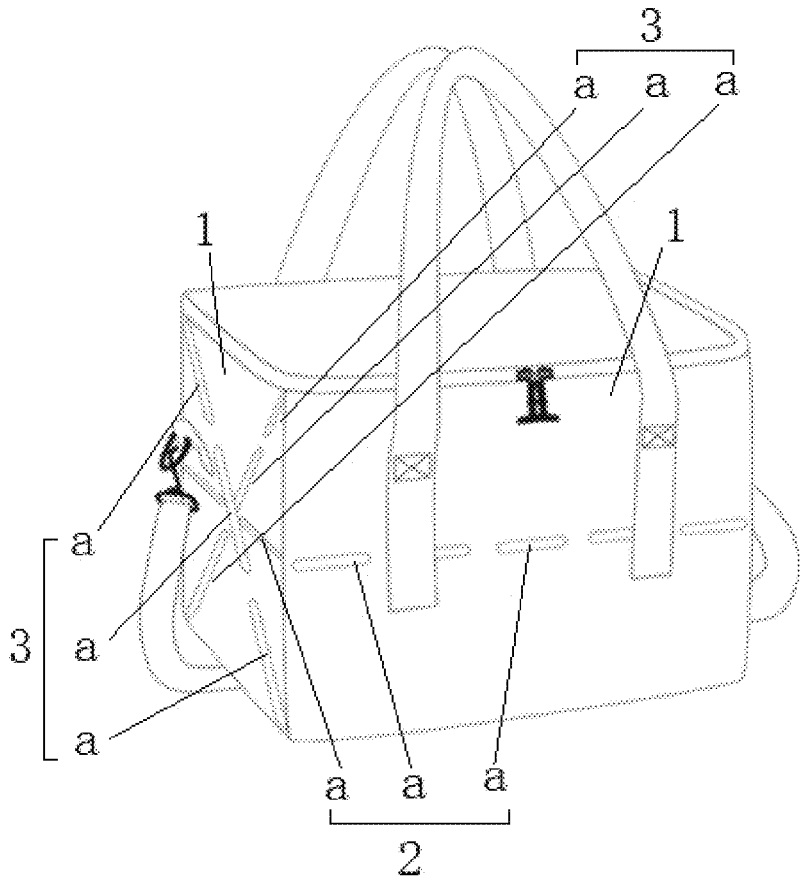
FIG. 20 shows a schematic diagram of a flexible bag body in an unfolded state according to an embodiment of the present disclosure.
Figure 21:
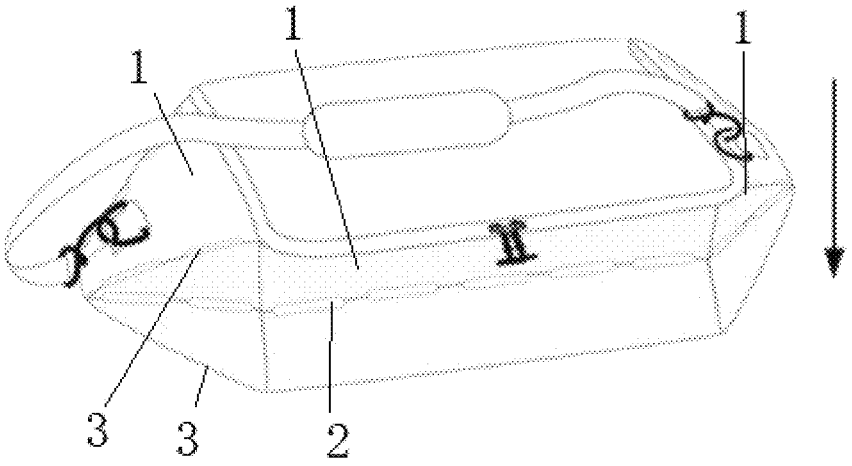
FIG. 21 shows a state diagram of the flexible bag body in FIG. 20 in a folding process.
Figure 22:
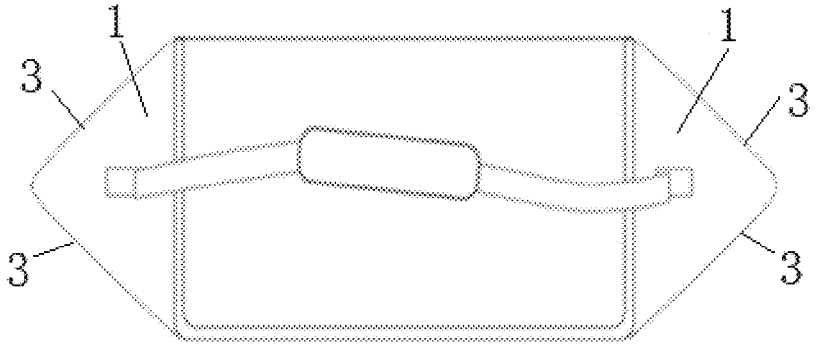
FIG. 22 shows a schematic diagram of the flexible bag body in FIG. 20 in a folded state.

In the fourth matching mode, as shown in FIG. 19*d*, both the cooler bag housing 200 and the flexible bag body 100 are provided with hook-and-loop fasteners 300, and the cooler bag housing 200 and the flexible bag body 100 are bonded and fixed through the hook-and-loop fasteners. Hook-and-loop fasteners are convenient and easy to use. When detaching the flexible bag body 100, one only needs to pull apart the hook-and-loop fasteners, making it user-friendly. Hook-and-loop fasteners are economically practical and inexpensive, further reducing costs.

The above disclosure presents numerous different embodiments or examples for realizing the different structures of the present disclosure. To streamline the disclosure, specific examples of components and configurations are described above. Naturally, these are merely illustrative and are not intended to limit the present disclosure. Furthermore, the present disclosure may repeat reference numerals and/or letters across different examples for simplicity and clarity; such repetition does not indicate any relationship between the various embodiments and/or configurations discussed. Additionally, the present disclosure provides examples of various specific processes and materials, but those of ordinary skill in the art may recognize the application of other processes and/or the use of other materials.

Although the preferred embodiments of the present disclosure have been described, those skilled in the art, upon being informed of the basic inventive concept, may make additional alterations and modifications to these embodiments. Therefore, the appended claims are intended to be interpreted as including the preferred embodiments as well as all alterations and modifications that fall within the scope of the present disclosure.

It is evident that those skilled in the art can make various changes and variations to the present disclosure without departing from its spirit and scope. Thus, if these modifications and variations of the present disclosure fall within the scope of the claims and their equivalents, the present disclosure is also intended to encompass these changes and variations.

What is claimed is:

1. A flexible bag body, wherein the flexible bag body is enclosed to form a cavity, and the flexible bag body is sequentially provided with an inner layer fabric, a filling layer and an outer layer fabric from inside to outside; the flexible bag body is provided with a plurality of crease portions, one of the plurality of crease portions comprises a plurality of grooves, and the plurality of grooves are formed in the flexible bag body along a predetermined track line;

the filling layer is provided with an opening, and the inner layer fabric and the outer layer fabric are connected at the opening, so that a surface of the inner layer fabric and a surface of the outer layer fabric are sunken to form one of the plurality of grooves; and the flexible bag body is provided a folded state and an unfolded state, and in the folded state, the flexible bag body is bent and deformed at least on two sides of a part of one of the plurality of crease portions.

2. The flexible bag body according to claim 1, wherein the flexible bag body comprises a plurality of side pieces, and the plurality of side pieces enclose to form the cavity; and one of the plurality of side pieces is provided with one of the plurality of crease portions.

3. The flexible bag body according to claim 1, wherein one of the plurality of grooves is a long strip groove; and when the flexible bag body is in the unfolded state and is supported on a horizontal supporting surface, one of the plurality of grooves is parallel to the horizontal supporting surface; or one of the plurality of grooves is perpendicular to the horizontal supporting surface; or an included angle is formed between one of the plurality of grooves and the horizontal supporting surface, and the included angle is an acute angle or an obtuse angle.

4. The flexible bag body according to claim 1, wherein a sealing cavity is formed between the inner layer fabric and the outer layer fabric;

the inner layer fabric or the outer layer fabric is provided with an air nozzle, and the air nozzle communicates with the sealing cavity; and one of the plurality of grooves is isolated from the sealing cavity.

5. The flexible bag body according to claim 1, wherein one of the plurality of crease portions comprises a first crease portion, and the first crease portion extends in a circumferential direction of the flexible bag body.

6. The flexible bag body according to claim 5, wherein the first crease portion comprises a plurality of grooves arranged at intervals, and connecting lines of all the grooves form an annular closed crease line.

7. The flexible bag body according to claim 6, wherein when the flexible bag body is in the unfolded state, all the grooves are located in the same plane.

8. The flexible bag body according to claim 1, wherein one of the plurality of crease portions comprises a plurality of second crease portions; and when the flexible bag body is in the unfolded state and is supported on the horizontal supporting surface, an included angle is formed between one of the plurality of second crease portions and the horizontal supporting surface.

9. The flexible bag body according to claim 8, wherein at least two intersecting second crease portions are respectively arranged on the two opposite side pieces of the flexible bag body, and four end portions of the two intersecting second crease portions are positioned away from each other in opposite directions.

10. The flexible bag body according to claim 8, wherein the flexible bag body comprises two first side pieces, a second side piece and a third side piece;

the second side piece and the third side piece are arranged on two sides of one of the two first side pieces respectively, and the second side piece and the third side piece are connected to the two first side pieces respectively; and two intersecting second crease portions are arranged on the two first side pieces, wherein one end of one of the two intersecting second crease portions extends to a midpoint or a top end point of a top of the second side piece, and another end of one of the two intersecting second crease portions extends to a midpoint or a bottom end point of a bottom of the third side piece; one end of another one of the two intersecting second crease portions extends to a midpoint or a top end point of a top of the third side piece, and another end of another one of the two intersecting second crease portions extends to a midpoint or a bottom end point of a bottom of the second side piece.

11. The flexible bag body according to claim 5, wherein one of the plurality of crease portions comprises a plurality of third crease portions, all the third crease portions are sequentially arranged at intervals in the circumferential direction of the flexible bag body, and an included angle is formed between one of the plurality of third crease portions and the first crease portion; and the flexible bag body is arranged to be rotated and folded in an inclination direction of one of the plurality of third crease portions, so that the height is reduced.

12. The flexible bag body according to claim 11, wherein the flexible bag body comprises a plurality of side pieces, and each of the plurality of side pieces is provided with at least one of the plurality of third crease portions.

13. The flexible bag body according to claim 11, wherein one of the plurality of third crease portions is arranged on an upper side and/or a lower side of the first crease portion.

14. The flexible bag body according to claim 11, wherein one of the plurality of third crease portions and the first crease portion are sequentially and alternately arranged in a height direction of the flexible bag body.

15. The flexible bag body according to claim 1, wherein one of the plurality of crease portions comprises a fourth crease portion, the fourth crease portion is distributed on a whole surface of the flexible bag body, and a plurality of triangular areas are formed between the fourth crease portions; and the flexible bag body is provided with a plurality of different folded states.

16. The flexible bag body according to claim 1, wherein one of the plurality of crease portions comprises a fifth crease portion, the fifth crease portion is distributed on the whole surface of the flexible bag body, a plurality of fifth crease portions are arranged, the plurality of fifth crease portions are parallel to the horizontal supporting surface, the plurality of fifth crease portions are perpendicular to the horizontal supporting surface, and a plurality of rectangular areas are formed between the fifth crease portions; and the flexible bag body is provided with a plurality of different folded states.

17. The flexible bag body according to claim 16, wherein two ends of a bottom of the flexible bag body further comprise a fifth crease portion that forms an included angle with the horizontal supporting surface, and fixing pieces matched with each other are arranged at the two ends of the bottom of the flexible bag body and two ends of a waist portion of the flexible bag body.

18. The flexible bag body according to claim 1, wherein the filling layer is provided with a plurality of hole portions; and in the unfolded state, the outer layer fabric forms an outer convex pattern at one of the plurality of hole portions.

19. The flexible bag body according to claim 1, wherein the filling layer is provided with a plurality of through holes.

20. A cooler bag, comprising:

a cooler bag housing; and the flexible bag body according to claim 1, wherein the flexible bag body is detachably connected to the cooler bag housing.

21. The cooler bag according to claim 20, wherein the cooler bag housing and the flexible bag body are matched in any one of the following modes:

the cooler bag housing is provided with an accommodating cavity, and the accommodating cavity is arranged to accommodate the flexible bag body;

the cooler bag housing is provided with a first magnetic attraction portion, the flexible bag body is provided with a second magnetic attraction portion, and the first magnetic attraction portion and the second magnetic attraction portion are magnetically attracted to each other;

the cooler bag housing is provided with a first buckle, the flexible bag body is provided with a second buckle, and the first buckle and the second buckle are clamped and fixed; and both the cooler bag housing and the flexible bag body are provided with hook-and-loop fasteners, and the cooler bag housing and the flexible bag body are bonded and fixed through the hook-and-loop fasteners.

* * * * *